US005955966A

United States Patent [19]

Jeffryes et al.

[11] Patent Number: 5,955,966

[45] Date of Patent: Sep. 21, 1999

[54] SIGNAL RECOGNITION SYSTEM FOR WELLBORE TELEMETRY

[75] Inventors: Benjamin P. Jeffryes, Histon; Timothy T. Jervis, Waterbeach, both of United Kingdom

[73] Assignee: Schlumberger Technology Corporation, Sugar Land, Tex.

[21] Appl. No.: 08/838,557

[22] Filed: Apr. 9, 1997

[51] Int. Cl.[6] ..... G01V 3/00

[52] U.S. Cl. ..... 340/853.1; 340/856.4; 367/81; 175/40

[58] Field of Search ..... 367/81; 340/853.1, 340/855.2, 853.9, 853.2, 856.4; 175/40

[56] References Cited

U.S. PATENT DOCUMENTS

| | | | |
|---|---|---|---|
| Re. 29,460 | 10/1977 | Mills | 364/724 |
| 3,544,723 | 12/1970 | Battista | 179/15 |
| 3,800,150 | 3/1974 | Givens | 250/262 |
| 3,961,167 | 6/1976 | Mills | 235/152 |
| 4,415,895 | 11/1983 | Flagg | 340/856.4 |
| 4,468,665 | 8/1984 | Thawley et al. | 340/853.2 |
| 4,903,245 | 2/1990 | Close et al. | 340/853.9 |
| 5,157,392 | 10/1992 | Zimmer | 340/853.9 |

*Primary Examiner*—Michael Horabik
*Assistant Examiner*—Timothy Edwards, Jr.
*Attorney, Agent, or Firm*—Peter Y. Lee; Wayne I. Kanak

[57] ABSTRACT

Methods and apparatus are described for recognizing wellbore telemetry signals, wherein a received analog telemetry signal is compared to a number of possible analog signals. The probability of representing the received signal is determined for each of the possible analog signals. By selecting the signal with the highest probability, the received signal is demodulated. For calculating the probability, Bayes' method or any equivalent thereof is used. In variants, this probabilistic method is used to determine the synchronization point of the telemetry signal and for controlling the noise removal therefrom. The method and apparatus show increased accuracy in recognizing and demodulating the received signals.

23 Claims, 3 Drawing Sheets

SIGNAL RECOGNITION SYSTEM FOR WELLBORE TELEMETRY

BACKGROUND OF THE INVENTION

1. Field of the Invention

The present invention relates an improved method and apparatus for demodulating a telemetry signal, i.e., recognizing or identifying digital information in an analog signal. Specifically it pertains to drilling telemetric systems in formation evaluation or borehole telemetry through noisy transmission channels.

2. Description of the Related Art

In the development, completion, and operation of natural hydrocarbon reservoirs, various telemetric systems and techniques are known and employed to achieve what is known in the art as measurement while drilling (MWD).

For the purpose of this application, MWD includes any type of data transmission from sensor units in the drill bit, bottom hole assembly, or any other part of the sub-surface drill string. Another acronym often encountered in the art besides MWD is LWD (Logging While Drilling). MWD includes in particular low data bit rate transmission systems, as operating below 10 KHz, preferably below 1 KHz, such as acoustic telemetry through the drill string itself, mud pulse or electro-magnetic telemetry. For the scope of the present invention however, the technological field can be better characterized by the ratio of the speed of data processing on the receiver side and the transmission rate. The computing speed is measured in floating point operations per second (flops). Thus, the invention is preferably operable for telemetry processing above $3*10^5$ flop/bit, more preferably above $4*10^5$ flop/bit.

In the currently prevailing techniques data are transmitted by means of a mud pressure pulse generator located either inside or being part of the drill string. The system generates pressure pulses in the drilling fluid or mud, typically by way of a valve or siren type of device. The pulses are detected at the surface by suitable means, e.g., pressure sensors, strain gages, accelerometers, and the like, which are in general directly attached to the drill string or the stand pipe.

Borehole telemetry is a well established technology. Improvements to this technology as have been made over the past decades are published for example in a large number of patents, including U.S. Pat. Nos. 3,790,930; 3,820,063; 4,739,325; 4,932,005.

Of particular interest for the scope of the present invention are the numerous attempts being made to improve the data detection of the transmitted data at the surface. It should be noted that the drilling process presents an exceedingly noisy environment for telemetry owing to the mechanical generation of broadband noise and to the drilling fluid circulation system.

To improve the signal-to-noise ratio, the data as gathered by the sensor units can be encoded such that the distortion by noise has less impact on the data recovery. Usually employed encoding schemes include Frequency Shift Keying (FSK), Phase Shift Keying (PSK) or m-ary pulse coding. Alternatively a binary non return to zero coding may be used. Different encoding methods are described for example in U.S. Pat. Nos. 3,789,355 and 4,562,559.

In U.S. Pat. No. 5,381,092 the signals from those sensors which evaluate the earth formation are subdivided prior to transmission into a plurality of groups, each group represented by one value.

In U.S. Pat. No. 5,055,837 an attempt is described to improve the quality of the transmission by determining a transfer function which characterizes the transmission properties of the drilling fluid column in the drill pipe.

In an acoustic telemetry system, as described in U.S. Pat. No. 5,128,901, the data signals are (pre-)conditioned to counteract distortions caused by the drill string.

A filtering technique to cancel or minimize noise in the transmitted data signals is disclosed in U.S. Pat. No. 4,878,206. This known approach uses independent measurements of the vibrations of the drill string at the surface to remove pressure disturbance caused by these vibrations and affecting the mud column pressure. A similar technique is known from U.S. Pat. No. 5,289,354.

The specific problem of bit synchronization is described for example in U.S. Pat. No. 4,001,775. Each bit is represented by a change in phase of an acoustic signal. In addition to this, each bit, i.e. each phase shift, is transmitted over a predetermined number of cycles generated by a reference clock.

A combinatorial solution for en- and decoding of MWD signals is known from U.S. Pat. No. 4,908,804. Each datum is transformed prior to transmission into one of a combinatorial set of a number of nominally identical pulses distributed over a larger number of subintervals of a fixed time interval.

The Bayesian theory to discern different hypothesis when given experimental evidence (data) has been attributed to Rev. Thomas Bayes, who first discovered it back in 1763. A modern summary of Bayesian theory is presented for example by E. T. Jaynes, in an article titled "Confidence Intervals versus Bayesian Intervals", which is published in: "Papers on Probability, Statistics and Statistical Physics", R. D. Rosenkrantz (Ed.), Kluwer, 1983, pp. 149–209.

A possible application of this theory to telemetry is described in a conference paper by C. S. Christensen, titled "An algorithm for telemetry decommutation using Bayesian decisions", published 1970 in: Proceedings of the 3rd Hawaii international conference on system science, B. S. M. Granborg (Ed.), pp. 822–4, by Western Periodicals Co., Hollywood, Calif., USA. The author applies a Bayesian decision algorithm to the received and demodulated string of bits in order to eliminate bit errors and to associate the corrected bits with one of several telemetry channels. This and similar methods have apparently been used when receiving signals transmitted from a spacecraft, such as launched by the National Aeronautics and Space Administration (NASA) in their Mariner and Voyager deep space exploration program.

To appreciate the scope of the present invention in the light of this prior art, it is important to note that Christensen does not attempt to solve the "demodulation" problem, i.e. the problem to translate the analog signal into a string of bits In view of the above cited prior art it is an object of the invention to provide an improved method and apparatus for demodulating an analog telemetry signal into a digital data signal. It is a further object of the invention to provide a drilling telemetry system with improved signal recognition. The system should be compatible with or independent from the various transmission media and encoding methods. It is a particular object of the invention to provide such a system for mud pulse telemetry in the low frequency domain.

SUMMARY OF THE INVENTION

These and further objects of the invention are achieved by apparatus and methods as set forth in the appended claims.

It is seen as an important element of the invention that the identification or demodulation of data from a transmitted analog telemetry signal is achieved by comparing a plurality of possible analog signals with the transmitted signal and selecting the one of said possible analog signals with the highest probability of representing the transmitted signal.

Possible signals can be all or a subset of those signals which are expected to be transmitted.

To fully appreciate the invention, it should be noted that the described process is entirely performed in the analog domain, i.e., before individual parts (bits) of data have been identified. As a matter of course, analog as used throughout this description also includes any "digitized" analog signal, as resulting for example from an analog-digital conversion (ADC).

The plurality of possible signals which are compared with the transmitted signal are preferably stored in a memory or generated on-the-fly. Preference of either method depends on the available equipment. The possible signals are generated using prior knowledge of the data transmitted and the distorting characteristics, or more generally, of the transfer function of the transmission channel. Given the transfer function and the data, the possible analog representations as are required for the present invention are generated by a convolution process.

The data are known digital coded telemetry or control signals with a limited range. However, it is a difficult task to establish the transfer function of the wellbore through which the data are transmitted in mud pulse or drill string telemetry. Thus, either a simple model such as a low-pass filter can be used or suitable test signals are transmitted and the transfer function is derived from a deconvolution process known as such in the art.

The comparison between received signal and the possible signals, and the selection of the most probable of those possible signals is based on a mathematical method named after Thomas Bayes. The present invention seeks to include all mathematical equivalents of this method as different notations, formulations, and presentation, thereof, appear in the relevant literature.

It is a preferred feature of the present invention to use first derivatives of signals to perform the comparisons. Even though most of the received signal's energy is concentrated in its dc component, it has been found that the use of first derivatives in place of the signals often provides superior results.

Another preferred embodiment of the invention comprises making use of prior knowledge of a data frame or format in which data are transmitted and thus identifying subsections of said data frame. In an alternative, data-independent embodiment, the possible signals can be groups consisting of all possible combinations of two bits. This data-independent variant might be extended to larger groups of bits, i.e., groups of three or four bits.

In a further embodiment, the synchronization or starting point in the transmitted signal is retrieved by comparing the probabilities of possible signals with different synchronization points. Other embodiments make use of sudden change of the variance of the signal between periods of silence and of data transmission, respectively, and employ possible signals with different variance.

In a further preferred embodiment, the synchronization point is determined by jogging or shifting a possible signal in time, determining the respective probabilities and determining the most probable. This process is preferably extended to several or all of the possible signals as the shift in the synchronization point has a major influence on the calculated probabilities.

In a further preferred embodiment of the invention, the calculated probability of a possible signal serves as a measure for determining the optimum level of noise removal.

These and other features of the invention, preferred embodiments and variants thereof, and advantages will become appreciated and understood be those skilled in the art from the detailed description and drawings following hereinbelow.

DESCRIPTION OF THE PREFERRED EMBODIMENT

Figure 1:
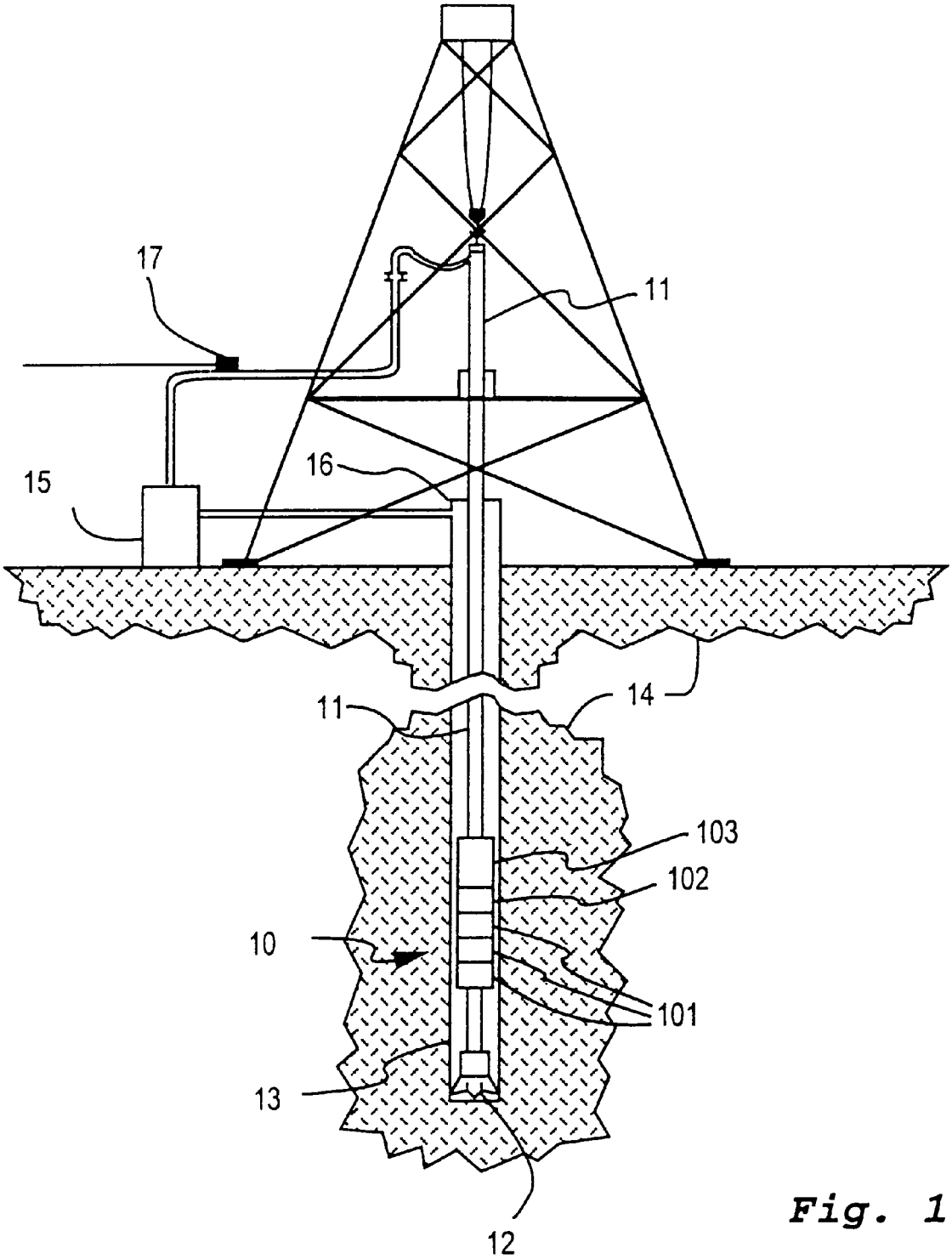
FIG. 1 shows a schematic view of a mud pressure pulse generator and drill string suitable for use in the present invention.

Referring now to the drawings, there is shown in FIG. 1 a tubular MWD tool 10 connected in a tubular drill string 11 having a rotary drill bit 12 coupled to the end thereof and arranged for drilling a borehole 13 through earth formations 14.

As the drill string 11 is rotated by the drilling rig, substantial volumes of drilling fluid ("drilling mud") are continuously pumped by mud pumps 15 down through the drill string 11 and discharged from the bit 14 to cool and lubricate the bit and carry away cuttings removed by the bit. The mud is returned to the surface along the annular space 16 existing between the walls of the borehole 13 and the exterior of the drill string 11. This circulating stream of mud can be used for the transmission of pressure pulse signal from the MWD tool 10 to the surface.

The MWD tool 10 of this example is an integral part of the drill-string bottom hole assembly. It comprises measuring devices 101 for environmental and drilling parameters and appropriate encoders 102 to reduce and refine electrical signals representative of the measured parameters for transmission via mud pulse telemetry signals to the surface. In this example the MWD tool measures direction and inclination of the hole, gamma radiation, temperature, and weight and torque on bit. Sensors and tools for other parameters such as downhole pressure, downhole resistivity or conductivity of the drilling mud or formation, neutron spectroscopy etc. might be added. It should however be obvious that the present invention is not concerned with any specific kind of parameter or measuring device as used in the wellbore.

Electrical power for the operation of the tool is provided by a battery producing electrical energy. The tool 10 also includes a modulator, or mud siren, 103 which selectively interrupts or obstructs the flow of the drilling mud through the drill string in order to produce pressure pulses in the mud. Suitable generators are for example described in U.S. Pat. Nos. 4,785,300; 4,847,815; 4,825,421; 4,839,870 and 5,073,877.

The modulator 103 is controlled such that the pressure pulses are produced in the form of encoded acoustic data signals which correspond to the encoded signals from the measuring devices 101. These signals, typically in the form of binary coded sequences, are transmitted to the surface by way of the mud flowing in the drill string.

In the present example NRZ (Non-Return-to-Zero) telemetry is used to communicate information to the surface. In NRZ modulation the symbols are binary ones and zeros. The system states are the modulator closed (corresponding to a one) and the modulator open (corresponding to a zero). Thus, if two succeeding bits are the same the modulator does not move. If a one follows a zero the modulator closes, if a zero follows a one the modulator opens.

Other signal modulation techniques are usable, and selection of the specific encoding and modulation schemes to be employed in connection with the operation of the modulator are matters of choice. A number of possible modulation schemes for acoustic borehole telemetry are described by S. P. Monroe, "Applying digital data-encoding techniques to mud pulse telemetry", Proceedings of the 5th SPE Petroleum Computer Conference, Denver, Jun. 25th–28th, 1990, SPE 20236, pp. 7–16.

When these signals reach the surface, they are detected, decoded and converted into meaningful data by a suitable signal detector, in the present example by an electromechanical transducer which is generally known in the art as SPT (Stand-pipe Pressure transducer) 17. Transducers suitable for a acoustic signal/pressure conversion into electrical signals are also found in the published UK Patent GB-A-2 140 599, in U.S. Pat. No. 5,222,049, and in the published International Patent Application WO-A-95/14 845.

The analog signal of the SPT is appropriately filtered and sampled at an appropriate frequency to derive a digitally coded representation of the analog signal, which then can be further processed as described in the following.

Conventional demodulation or bit detection is based on threshold detection. If the current system state is that the actuator is open then the pressure at the SPT must rise more than the threshold amount to register a one, otherwise a zero is registered. Similarly, to register a zero after a one the pressure at the SPT must fall by more than the threshold value.

Even if the SPT received the transmitted signal with no distortion due to the travel path, this method has problems to cope with noise if the noise amplitude instantaneously exceeds the pressure change on opening or shutting the actuator. The effects of the travel path exacerbate this.

In the encoding scheme of this embodiment the data is formatted, i.e., grouped into data frames. Each data frame begins with a standard bit sequence for synchronization, and each data word is preceded by a one and followed by a zero. A check sum is also calculated, and this is transmitted along with the data. The data words are all 8 bits long or less. A full specification of the data format is presented hereinbelow.

Using knowledge of the acoustic response of the system to the NRZ signal, and the available knowledge of the format and contents of the data, the present invention can be used as an improved method of signal recognition.

Figure 2:
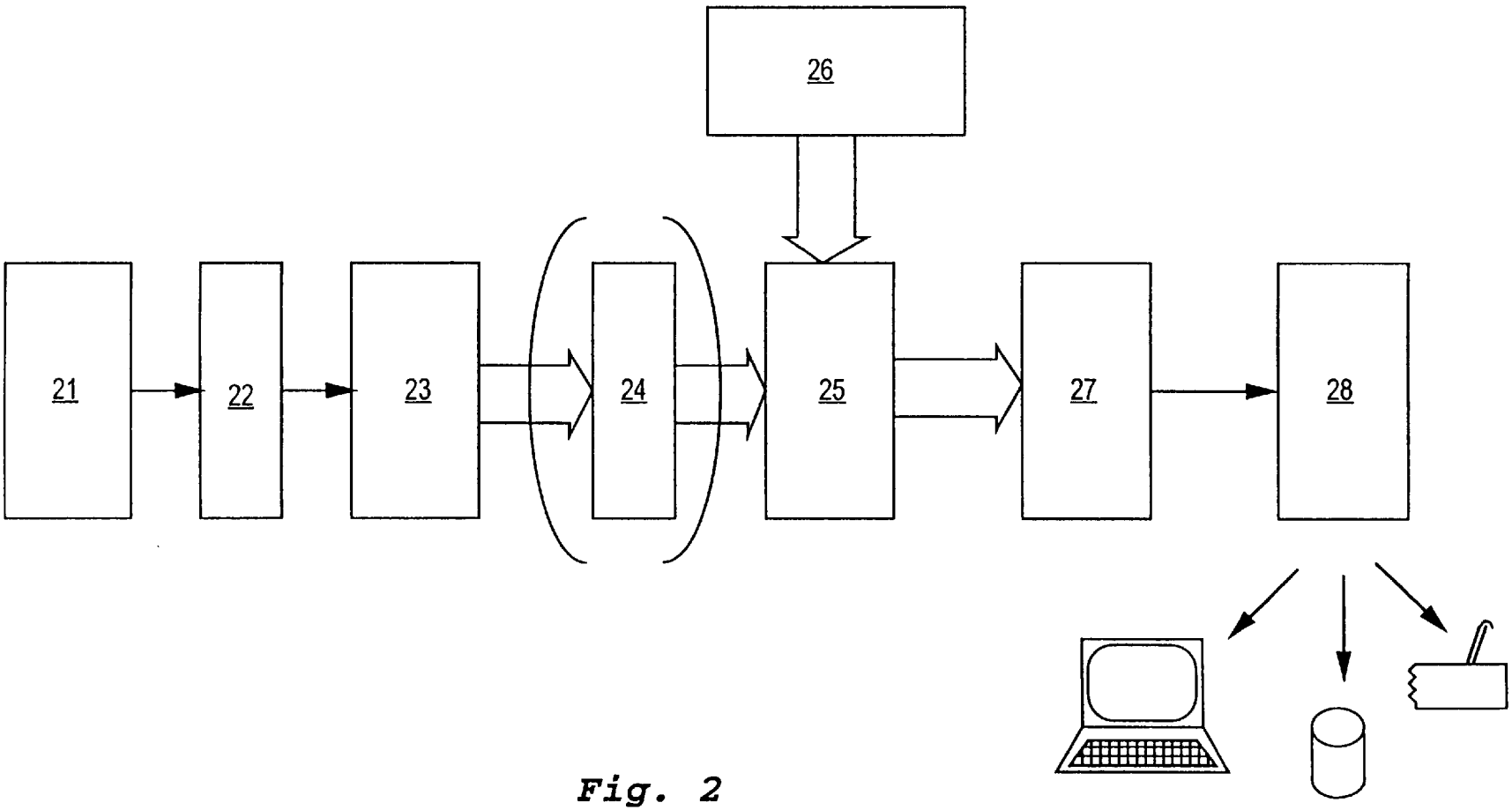
FIG. 2 illustrates major functional blocks of a decoding system in accordance with the present invention.

Before describing the new features of an example with reference to the block diagram shown in FIG. 2, important formulas of the Bayesian theory are shortly summarized.

Given some data D, and a model M, the basic theorem of Bayes states $$\Pr(M \mid D) = \frac{\Pr(D \mid M)\Pr(M)}{\Pr(D)} \qquad [1]$$

The quantity of interest is Pr (M|D), known as the posterior probability of the model M in light of the data D, Pr (D|M) is the likelihood of the data given the model, Pr (M) is the prior probability of the model. The latter represents the prior belief in the chosen model. The denominator Pr (D) is a normalization term that has the same value for different models applied to the same data. This means that the relative probability of different models on the same data could be found without finding an absolute value for Pr (D). This is conditional, however, on evaluating the likelihood Pr (D|M). The Bayesian approach treats this problem as another application of Bayes' rule:

$$\Pr(\mu, \sigma, \mid D, M) = \frac{\Pr(D \mid \mu, \sigma, M)\Pr(\mu, \sigma \mid M)}{\Pr(D \mid M)} \qquad [2]$$

Equation 2 gives the posterior probability of the model parameters (in the example: the mean $\mu$ and the variance $\sigma$, respectively, of a Gaussian model) as a function of the data likelihood, a prior for the parameters, and a normalizing constant. The likelihood can be explicitly evaluated given values for $\mu$ and $\sigma$. The prior is a joint probability distribution over the two parameters given the chosen model assumption. The normalization term is the quantity of interest in equation 1.

The normalization term can be extracted from equation [2] by integrating the left hand side over all possible values of the model parameters. Integrating a distribution over all possible events gives unity, and since the denominator is independent of $\mu$ and $\sigma$, the value of Pr (D|M) can be determined by $$\Pr(D \mid M) = \int_{\mu,\sigma} \Pr(D \mid \mu, \sigma, M)\Pr(\mu, \sigma \mid M) \qquad [3]$$

Thus equation [3] gives the term required in equation 1. This procedure is known as integrating out nuisance parameters, and is one of the features of Bayesian statistics. The difficulty of the integration depends on the form of the prior. If the models are Gaussian, the integration is usually analytically tractable. Monte-Carlo numerical solutions have been used for other cases. In some situations, the integration can be approximated closely enough by summing probabilities of discrete models. The latter variant is used in this embodiment to determine the denominator and, hence, the evidence, following an approach described as such for example by D. MacKay in: Neural Computation, Vol. 4 (1992), No. 3, pp. 415–472, and no. 5, pp. 698–714.

In the present embodiment of the invention, the data are the samples from the SPT, and the Bayesian inference problem is to detect the data as transmitted from the downhole MWD tool.

From prior knowledge or assumptions a set of possible data words for the signal is derived. The probability of each data word of the set is compared to that of other words of the same set.

The signal path is schematically depicted by FIG. 2.

The analog signal, as measured by the SPT equipment 21, is sampled and digitized in an Analog-to-Digital converter (ADC) 22. The such digitized analog signal is stored in a buffer 23 which collects data to form a signal vector, comprising 84 seconds of the signal. An optional subsequent differentiator 24 generates the first derivative of the original signal. The signal vector or its first derivative enters as input to a probabilistic comparator 25 which calculates the likelihood or probability of a model vector to represent the actual data vector. The comparator refers to a database 26 which stores precalculated representations of possible data vectors. This database could easily be replaced by a dedicated engine which generates a sequence of possible data vectors on-the-fly, using a convolution process with a transfer function.

The output of the probabilistic comparator 25 is a vector of calculated probabilities associated with the tested possible data vectors. A decoder 27 evaluates the probabilities of measurement data and cyclic redundancy check (CRC) information related to said measurements data and thereafter selects the most likely representation of the transmitted signal. The selected signal is presented as log information 28, which can be either printed, displayed, or stored.

Figure 3:
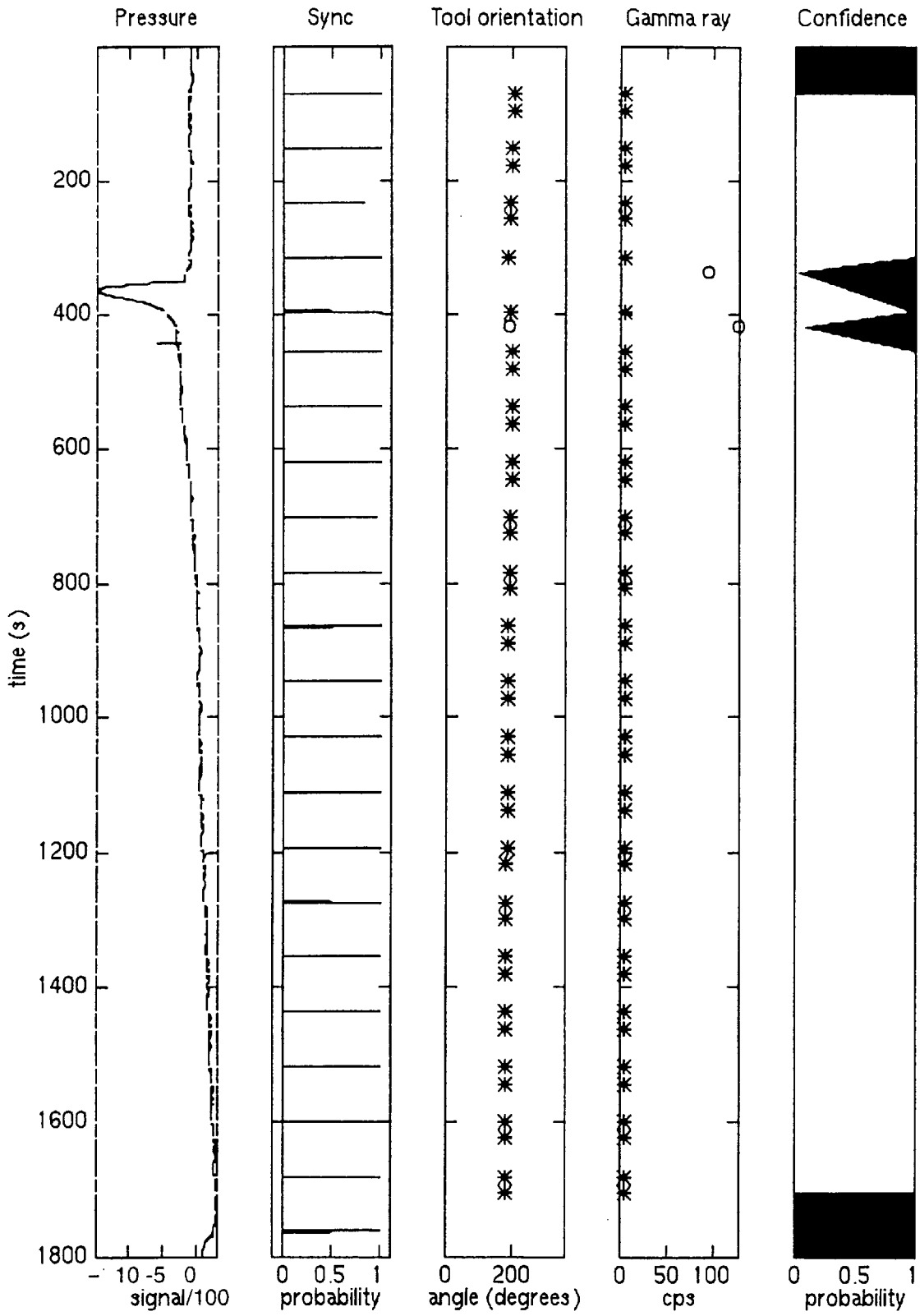
FIG. 3 shows log information as generated by using an embodiment of the present invention.

An example of the log information is displayed in FIG. 3.

It is in important feature of the invention that the log output is not necessarily restricted to the most probable of the stored possible data vectors. Using data calculated during the process, confidence information, such as the calculated absolute probability/evidence can be made available to the user. It is also possible to display several possible data vectors as a result of the process, combined with ranking information which in turn again is related to the calculated probabilities.

In the following table an example of a formatted data string as transmitted by the downhole equipment is listed:

| Bit index in frame | Bits | Meaning |
|---|---|---|
| 1–3 | 110 | synchronization |
| 4 | 1 | start |
| 5–10 | [6] | tool face orientation 1 |
| 11 | [1] | M/H |
| 12 | 0 | stop |
| 13 | 1 | start |
| 14–21 | [8] | gamma ray 1 |
| 22 | 0 | stop |
| 23 | 1 | start |
| 24–28 | [5] | crc 1 |
| 29 | 0 | stop |
| 30 | 1 | start |
| 31–36 | [6] | tool face orientation 2 |
| 37 | [1] | M/H |
| 38 | 0 | stop |
| 39 | 1 | start |
| 40–47 | [8] | gamma ray 2 |
| 48 | 0 | stop |
| 49 | 1 | start |
| 50–54 | [5] | crc 2 |
| 55 | 0 | stop |
| 56 | 1 | start |
| 57–60 | [4] | shock |
| 61 | [1] | P |
| 62 | 0 | stop |

where [n] indicates n bits, and 1 and 0 stand for themselves.

In the present example, for the purpose of forming a data model, the start and stop bits are treated as (known) parts of the data signal which they delimit.

Assuming that synchronization is achieved in accordance with the steps described above or by any other known method, only the sensor information, i.e. 7 and 8 bit data words, can vary at least theoretically over all $2^n$ possible values with "n" denoting the number of bits of the data word. Hence each set of possible words contains 256 different words at the most. Each possible word enters the Bayesian formula (eq. [1]) as a model M and its probability against the received signals can be calculated accordingly.

The use of check-sum information allows further probabilistic evaluation. Most of the data words are transmitted with some redundancy, containing 15 data bits, followed by a 5 bit check sum derived from the data. The a-priori knowledge of the check sum bits, given the data bits, improves the performance of the demodulation. The probability of each data word is proportional to the relative probability of each data word independently, times the relative probability of the check sum word derived from it. Although theoretically this increases the number of calculations of probability from $2^8$ to $2^{15}$, in practice, selecting on only the more probable (for instance the most probable 32) of each word allows the most probable demodulation to be found, and if it does not then the absolute probability of the demodulation will be so low as to fall below any reasonable threshold. However, it is also not unreasonable to compute all $2^{15}$=32768 probabilities.

The probabilistic comparator 25 of FIG. 2 generates a vector comprising the normalized posterior probabilities for all possible data vectors or models by a process comprising the steps of:

1. Calculating the residuals between a model data and the signal data along the length of the vector, where the kth element $r_k$ of the residual vector r is the difference between the model and the signal for sample k.

2. Assuming the residuals form a Gaussian distribution with zero mean, the variance of the this distribution is calculated according to $$\sigma^2 = \max\left(\frac{r^T r}{n-1}, \sigma_1^2\right) \quad [4]$$

with n denoting the number of samples or elements in the model and signal data vector and the corresponding residual vector, multiplied by an oversampling factor (Fs/2*Fc), where Fs is the sampling frequency and Fc is the cut-off frequency of the filtered signal. A lower bound $\sigma_1^2$ is introduced to avoid taking a logarithm of zero. The larger the size of this lower boundary is chosen, the larger is the likelihood of the best fit model when the noise is insignificant. Suitable values for $\sigma_1^2$ are $10^{-10}$ or $10^{-20}$ both of which are indistinguishable in computing devices with 32 bit data register.

3. Given $\sigma^2$ the logarithm 1 of the likelihood for the data given the model is calculated by $$l = -\frac{n}{2}\log(2\pi\sigma^2) - \frac{n-1}{2} \quad [5]$$

The calculation is simplified because the variance of the distribution is set at the sample variance of the data. The residue between the signal data and the possible data model enters the likelihood through the variance.

This calculation process is extended to parts, sub-groups, channels, and the like, of the signal, in which case the likelihood of the complete data model is given by the product of the likelihood for each part, sub-group, channel etc.

To generate from the likelihoods for each of the possible data vector a vector which contains the normalized Bayesian posterior probability (cf. eq. [1]) following steps are performed:

1. Generating a logarithmic likelihood vector l , where the kth element is the logarithmic likelihood of a model k as calculated in accordance with eq. [4] and [5].

2. Scaling the logarithmic likelihood vector l to form a scaled logarithmic likelihood vector $l_s$ by $$l_s = l - max(l) \quad [6]$$

where max(l) is the maximum of the elements of l.

3. Evaluating the un-normalized posterior probability by $$Pr_u = exp(l_s) \otimes Pr(M) \quad [7]$$

where Pr(M) is a vector of the normalized prior probabilities of the model data such that the kth element of Pr(M) is the normalized prior probability of the model k (in this example all models have the same prior probability), ⊗ denotes an element-wise multiplication operator and expo ( ) is an element-wise exponentiation operator.

4. To generate a vector Pr containing the normalized posterior probabilities, the vector $Pr_u$ is divided by the scalar sum of its elements:

$$Pr = \frac{Pr_u}{\sum_k Pr_u} \quad [8]$$

It will be appreciated by those skilled in the art that the above described method of evaluating the posterior probability by using scaled vectors and calculating with logarithms avoids divisions by zero and significantly reduces the number and complexity of computational operations. However, it is obviously possible to calculate the posterior probabilities using for example the actual values for the Gaussian model in place of their logarithms. The Gaussian model for the distribution of the residues further constitutes a particularly advantageous model, other known or even specifically designed models for the distribution could be applied.

In the following variants of the invention, use is made of further information and assumptions characterizing the signal transmission and being available prior to the data transmission or derivable during the data transmission. These variants can also be used to refine and accelerate the basic signal recognition process as described hereinbefore.

Generally results generated by the new method can be improved by taking the first derivative of the analog telemetry signal rather than the signal itself as input data for the demodulation process.

In a further step, a transfer function for the transmission channel from the modulator 103 to the SPT is derived.

In practice the transfer function is unlikely to be known exactly. Even if the shape of the transfer function were known, difficulties of SPT calibration and actuator variation mean that the overall scale factor is relatively unpredictable. These difficulties can be overcome by deriving scale information from the data itself, and using multiple transfer function models in a Bayesian demodulation process. In other words, several models of the transmission channel can be tested against the received data.

The present embodiment uses as a model for the transmission channel, i.e. as a transfer function, a low pass filter with 0.7 Hz as cut-off frequency.

In a further step, noise is removed from the data.

To remove noise all frequency components higher than 0.7 Hz are filtered from the signal by means of a cut-off filter. The cut-off frequency is determined by the known bandwidth of the signal as generated by the modulator. Other characteristics of the signal or noise can be employed to design a filter which effectively rejects at least a part of the noise.

In addition to the filtering step, noise is reduced by applying Bayes' theorem to the data and a model of the data including a noise model. Then the evidence, which is the normalization constant in eq. [1], can be compared for this data model and a second (noise-free) data model which does not make any assumption about the noise.

Alternatively or in addition to the above, several noise models may be tested by comparing their respective evidence. It is further possible to optimize a noise model by adjusting one or a plurality of parameters of the noise model by determining a maximum of the evidence with respect to those parameters.

It is also possible to base the noise models on estimations or measurements on known noise sources such as the mud pumps 15.

A further step includes the detection of synchronization signals as being transmitted within each data frame generated by the downhole modulator. Synchronization is an important part of telemetry demodulation, since the demodulation can be completely wrong if the models are fitted to the wrong part of the data.

A synchronization point can be found by evaluating the probabilities of several data frame models, each modeling a different synchronization time. By taking data over an inter-sync period, and applying models representing a frame starting at all points in this period, the synchronization point can be determined.

A quicker evaluation can be made by including fewer models, covering for example a synchronization point every other sample One model that has been used successfully is of a constant mean, stepped variance model to fit the derivative of the data. Where the data burst starts, the derivative changes sharply. In between bursts (between the end of the data and the start of the next sync pulse) the signal is quiet and ideally the derivative is close to zero. A stepped variance model fits a wide variance to the data and a narrow variance to the quiet period.

Alternatively, stepped-mean Gaussian models of the mean power in the derivative can be used. The square of the derivative can be fitted quickly to several such models by forming cumulative sums along the data and making subtractions to find sums of statistics of the data for this purpose.

When the data burst length is unknown, several models of the data starting at the same synchronization time are needed. The model probabilities are integrated and compared with sums of other models of different synchronization times and data lengths.

This model-based method of synchronization can be used as a rough starting point for a more finely-tuned method using model evidences.

By using the model evidences, synchronization can be found to within a sample of the data.

This can be done as follows. The probability of each member of a set of models for a section of the data is evaluated. The same models are used and their probabilities re-evaluated at points displaced over a range of candidate synchronization points either side of the original, that is, the section of interest is moved around a sample or two.

Jogging the section left and right means the data in the Bayes calculation is not the same. This would appear to present a problem in comparing the evidences since Bayes' rule (equation [1]) requires the data to be the same. This problem can be side-stepped by considering the data to be fixed but wide enough to span all the sections of interest, and by considering the models to be extended over the extra data points by including some broad-variance elements. The models will all have the same number of broad-variance elements, so they will be comparable, and now the data is the same. This is a theoretical device and can be ignored in practice.

Once the model probabilities for each jogged section have been found, the evidences can be calculated. The section associated with the greatest evidence gives the best synchronization point. It is this set of models that can be used to decode the data.

This technique can be time consuming if there are many candidate synchronization points. The number of candidate points can be reduced by finding a rough synchronization point first, as described above.

An efficient way to use these two techniques is to find the synchronization point to within a few samples with the model-based method, and then to evaluate the remaining samples using the evidence method. How many "a few" is will depend on the amount of data, the models, and the available computing resources.

A log resulting from an application of the example to a mud pressure signal is shown in FIG. 3. Displayed is from the left side, the pressure signal of the SPT versus time in seconds, the synchronization points as probability versus time, the identified and decoded tool orientation in degrees, the identified and decoded output of the gamma-ray counter in counts per second (cps), and a "confidence log", which shows the probability of the related identified and decoded value. It can be seen that the sudden rise of pressure at approximately 350 seconds distorted the signal such that the identified and decoded values (denoted by open circles) show only a small probability. This is in contrast to the rest of the values (denotes by stars) which are identified with a probability of close to 1. In the displayed data set, some data appears to be missing, as evidenced by the change in the sync timing at around 450 seconds. The algorithm however automatically adjusts for this glitch and continues to decode.

In another variant of the invention, the set of possible data words is based on a transition model. The transition models reflects the response of the transmission channel to a change from its current state into the following. For digital coded information the transmission channel, assumed to be originally in a state "0", can change into "1" or remain "0" in the following bit-time. Hence, this data model leads to set of four possible transitions, 00, 01, 10, 11, each of which is described by a probability distribution, which in turn can be characterized by parameters such as mean and variance. Hence, any two subsequently received signals are compared to the expected response of the transmission channel to each one of the four possible transitions. In the absence of any other information, the most probable transition is selected.

The method has the advantage of minimizing the necessary knowledge or assumptions with respect to the transmission channel and/or the signals. The probability distribution can even be derived from a history of recognized signals.

In many cases the assumption can be used that each transition distribution (in this model there are four) is Gaussian. The only parameters of the Gaussian distribution are the mean and variance. Given a successfully demodulated signal then the actual pressure changes produced by each bit transition may be determined, and their sample mean and variance may be used as estimators for the Gaussian parameters.

To allow for a slow change in the distribution parameters, a moving buffer of the most recently demodulated data frames can be used to evaluate the statistics.

Another possibility is to use values of the means from previous experience in similar situations. Yet another is to use the data from the synchronization bits, which will be described in greater detail below, at the start of the first data frame, and to make a few simplifying assumptions. If it is assumed that the absolute value of the pressure change going from a one to a zero is the same as from a zero to a one, and similarly for a one-one transition and a zero-zero transition, and that the variances for each distribution are the same, then the synchronization bits allow a reasonable first estimate of the transition model parameters—so long as the data is not too noisy.

Once the entire first frame has been demodulated a better probability model can be used. If this self-consistent method is not successful, but the data frame can be demodulated by other means (a human operator for instance), then the statistics can still be evaluated in order to produce a model for the next data frame.

The above described variant, which is based on a transition model, can be enhanced by taking into account transitions in two or more bit-times, e.g., transition from 00 to 00, 01, 10, 11 and so forth.

We claim:

1. A receiver for wellbore telemetry or control signals, said receiver comprising:

an input connector to connect to a signal transmission channel between a surface location and a location within a drillstring in the vicinity of a drill bit;

a demodulator for converting signals received while drilling into binary data for further processing;

said demodulator including a generator for generating a plurality of possible analog signals, said possible signals being representations of signals expected to be received while drilling via said transmission channel, and a comparator connected to said generator and connected to said input connector for selecting from said plurality of possible analog signals one signal with the highest probability of representing a signal received via said transmission channel while drilling and thereby demodulating said received signal.

2. The receiver of claim 1, wherein the comparator comprises means using a Bayesain based method for determining the probability of representing the received signal.

3. The receiver of claim 1, wherein the comparator comprises means for determining a residual of the received signal and a one of the possible signals.

4. The receiver of claim 1, wherein the analog signals are replaced by their first derivatives.

5. The receiver of claim 1, further comprising means for removing noise from the data, wherein said noise removal means include means for determining for a one of the possible signals before and after noise removal the probability of representing the received signal.

6. The receiver of claim 1, further comprising means for removing noise from the data, wherein said noise removal means include means for comparing for a one of the possible signals after noise removal the probability of representing the received signal to select an optimum noise model from at least two different noise models.

7. The receiver of claim 1, wherein the generator comprises means for storing and retrieving said plurality of possible signals, means for generating a possible signal on-the-fly, or a combination thereof.

8. The receiver of claim 1, wherein the input connector in operation receives signals from a transducer connected to a surface section of the drillstring.

9. The receiver of claim 1, further comprising synchronization means for determining a synchronization or a starting point of data transmission in the received signal, said synchronization means comprising means for comparing for possible signals with different synchronization or starting points their probability of representing the received signal.

10. The receiver of claim 9, wherein the synchronization means comprises means for jogging the synchronization or starting point of a one of the possible signals and means for comparing for said one signal with jogged synchronization or starting points the probability of representing the received signal.

11. Receiving apparatus for gathering data related to subsurface conditions, said apparatus including means for reconverting analog signals received via a signal transmission channel between a surface location and a location within a drillstring in the vicinity of a drill bit into processable digital data, characterized in that said reconverting means comprises means for selecting from a plurality of possible analog signals one signal with the highest probability of representing said received signal, means for demodulating said most likely analog signal into said processable digital data, and means for displaying probability related information together with other log information.

12. Method for identifying a signal comprising the steps of:

transmitting a digital coded wellbore telemetry signal through a signal transmission channel between a surface location and a location within a drillstring in the vicinity of a drill bit;

receiving said signal as distorted by transmission through said channel;

generating at a receiving location a plurality of possible analog signals; and demodulating said received signal into binary data for further processing by selecting from said plurality of possible analog signals one signal with the highest probability of representing said received signal.

13. The method of claim 12, using a Bayesian based method for selecting the one signal with the highest probability of representing a received signal.

14. The method of claim 12, wherein the step of selecting the one signal with the highest probability of representing said received signal comprises the step of determining a residual of the received signal and a one of the possible signals.

15. The method of claim 12, wherein the analog signals are replaced by their first derivatives.

16. The method of claim 12, wherein the plurality of possible signals are generated using information about format and/or content of the transmitted data.

17. The method of claim 12, wherein the plurality of possible signals are generated using information about transition between single bits or groups of bits.

18. The method of claim 12, using redundancy in the received signal for determining the highest probability signal by the steps of independently determining for possible signals their probability of representing redundant parts of said received signal and selecting a combination of said possible signals with the highest combined probability.

19. The method of claim 12, further comprising the step of adding noise to the possible signals, wherein said noise adding step includes the step of determining for a possible signal before and after noise adding the probability of representing the received signal.

20. The method of claim 12, further comprising the step of adding noise to the possible signals, wherein said noise adding step includes the step of comparing for the signals after noise adding their respective probability of representing the received signal in order to select an optimum noise representation from at least two different noise representations.

21. The method of claim 12, wherein the step of generating the plurality of possible signals includes storing and retrieving said possible signals, or the step of generating said possible signals on-the-fly, or a combination thereof.

22. The method of claim 12, further comprising the step of determining a synchronization or a starting point of data transmission in the telemetry signal, said synchronization step comprising the step of comparing for possible signals with different synchronization or starting points their probability of representing the received signal.

23. The method of claim 22, wherein the synchronization step comprises the step of jogging the synchronization or starting point of a one of the possible signals and means for comparing at each jogged synchronization or starting point for said one signal its probability of representing the received signal.

* * * * *